US008985816B2

(12) United States Patent
Guercio et al.

(10) Patent No.: US 8,985,816 B2
(45) Date of Patent: Mar. 24, 2015

(54) LIGHT FIXTURE WITH CENTRAL LIGHTING HOUSING AND PERIPHERAL COOLING HOUSING

(71) Applicant: RAB Lighting Inc., Northvale, NJ (US)

(72) Inventors: Vincenzo Guercio, Wallkill, NY (US); Jiang Hu, Ningbo (CN); Dan Wang-Munson, Bergenfield, NJ (US)

(73) Assignee: RAB Lighting Inc., Northvale, NJ (US)

( * ) Notice: Subject to any disclaimer, the term of this patent is extended or adjusted under 35 U.S.C. 154(b) by 99 days.

(21) Appl. No.: 13/908,526

(22) Filed: Jun. 3, 2013

(65) Prior Publication Data

US 2013/0322079 A1 Dec. 5, 2013

Related U.S. Application Data

(60) Provisional application No. 61/654,761, filed on Jun. 1, 2012.

(51) Int. Cl.

| | |
|---|---|
| ***F21V 29/00*** | (2006.01) |
| ***F21S 8/04*** | (2006.01) |
| *F21Y 101/02* | (2006.01) |

(52) U.S. Cl.

CPC ..... *F21V 29/004* (2013.01); *F21S 8/04* (2013.01); *F21V 29/2231* (2013.01); *F21V 29/2293* (2013.01); *F21Y 2101/02* (2013.01)

USPC ..... 362/373; 362/294; 362/249.02; 362/147

(58) Field of Classification Search

CPC ..... F21V 29/004; F21V 8/04; F21S 8/04

USPC ..... 362/373, 294, 249.02, 147

See application file for complete search history.

(56) References Cited

U.S. PATENT DOCUMENTS

| | | | |
|---|---|---|---|
| D407,836 | S | 4/1999 | Leen |
| D437,958 | S | 2/2001 | Doron, Jr. et al. |
| 6,527,422 | B1 | 3/2003 | Hutchison |
| D473,529 | S | 4/2003 | Feinbloom |
| D516,229 | S | 2/2006 | Tang |
| D527,119 | S | 8/2006 | Maxik et al. |
| D528,673 | S | 9/2006 | Maxik et al. |
| D545,457 | S | 6/2007 | Chen |

(Continued)

FOREIGN PATENT DOCUMENTS

| | | |
|---|---|---|
| CN | 201582666 | 9/2010 |

OTHER PUBLICATIONS

Philips, The art of superior LED luminaire design, 2011, Union NJ, www.philipsna.com.

*Primary Examiner* — Ali Alavi

(74) *Attorney, Agent, or Firm* — SmithAmundsen LLC; Kelly J. Smith; Dennis S. Schell

(57) ABSTRACT

An illustrative light fixture includes a cylindrical lighting package housing surrounded peripherally by a cooling housing providing airflow cooling channels. The airflow cooling channels are defined in the space between the circumference of the cylindrical lighting package housing and a rim around the periphery of the light fixture. The cooling housing provides wide and long openings for air to rise vertically from below and through the airflow channels defined in part by cooling fins, and radial exit channels with vertical space for radially outward flow below a ceiling the fixture is mounted on, while also eliminating or minimizing the view through the airflow channels and to the ceiling.

20 Claims, 7 Drawing Sheets

(56) References Cited

U.S. PATENT DOCUMENTS

| | | | | |
|---|---|---|---|---|
| D545,472 | S | 6/2007 | Guercio | |
| D547,466 | S | 7/2007 | Lo | |
| D552,778 | S | 10/2007 | Butler | |
| D556,935 | S | 12/2007 | Quioque et al. | |
| D566,300 | S | 4/2008 | Lo | |
| D570,027 | S | 5/2008 | Miller et al. | |
| D571,494 | S | 6/2008 | Friedman et al. | |
| D573,288 | S | 7/2008 | Xu et al. | |
| D573,289 | S | 7/2008 | Xu et al. | |
| D573,294 | S | 7/2008 | Chan et al. | |
| 7,434,959 | B1 | 10/2008 | Wang | |
| D581,583 | S | 11/2008 | Peng | |
| D582,579 | S | 12/2008 | Tsai et al. | |
| 7,458,706 | B1 | 12/2008 | Liu et al. | |
| D586,497 | S | 2/2009 | Wu et al. | |
| D587,383 | S | 2/2009 | Wei | |
| D590,077 | S | 4/2009 | Grajcar | |
| 7,549,774 | B2 | 6/2009 | Tsai | |
| D596,765 | S | 7/2009 | Chiu | |
| D599,041 | S | 8/2009 | Yoo | |
| D601,276 | S | 9/2009 | Grajcar | |
| D601,279 | S | 9/2009 | Ou et al. | |
| 7,637,636 | B2 | 12/2009 | Zheng | |
| D610,723 | S | 2/2010 | Grajcar | |
| D614,336 | S | 4/2010 | Zheng et al. | |
| D616,576 | S | 5/2010 | Wang et al. | |
| D617,014 | S | 6/2010 | Foo | |
| D626,260 | S | 10/2010 | Wei | |
| 7,819,556 | B2 | 10/2010 | Heffington et al. | |
| 7,832,898 | B2 | 11/2010 | Li | |
| 7,841,734 | B2 | 11/2010 | Wilcox | |
| 7,854,534 | B2 | 12/2010 | Liu | |
| 7,874,697 | B2 | 1/2011 | Biebel et al. | |
| 7,878,697 | B2 | 2/2011 | Chiang | |
| D636,920 | S | 4/2011 | Boissevain | |
| 7,959,327 | B2 | 6/2011 | Lai et al. | |
| D642,316 | S | 7/2011 | Zheng | |
| 7,976,197 | B2 | 7/2011 | Chen | |
| D642,703 | S | 8/2011 | Li et al. | |
| D659,280 | S | 5/2012 | Guercio et al. | |
| 8,256,934 | B2 * | 9/2012 | Cunius | 362/373 |
| D668,370 | S | 10/2012 | Guercio et al. | |
| 8,297,798 | B1 * | 10/2012 | Pittman et al. | 362/296.05 |
| D672,076 | S | 12/2012 | Guercio et al. | |
| D673,320 | S | 12/2012 | Guercio et al. | |
| D679,856 | S | 4/2013 | Guercio et al. | |
| D690,450 | S * | 9/2013 | Guercio et al. | D26/72 |
| D690,453 | S * | 9/2013 | Guercio et al. | D26/88 |
| 8,568,000 | B2 * | 10/2013 | Yang | 362/373 |
| 8,702,259 | B2 * | 4/2014 | Maxik et al. | 362/84 |
| 2006/0203510 | A1 | 9/2006 | Noh et al. | |
| 2008/0266866 | A1 | 10/2008 | Tsai | |
| 2009/0103308 | A1 | 4/2009 | Xu et al. | |
| 2009/0196037 | A1 | 8/2009 | Xiao et al. | |
| 2010/0033971 | A1 | 2/2010 | Lu et al. | |
| 2010/0296287 | A1 | 11/2010 | Huang | |
| 2010/0328956 | A1 | 12/2010 | Zhang | |
| 2011/0018418 | A1 | 1/2011 | Yoo | |
| 2011/0110081 | A1 | 5/2011 | Belknap et al. | |
| 2012/0106176 | A1 * | 5/2012 | Lopez et al. | 362/382 |
| 2013/0088882 | A1 | 4/2013 | Guercio et al. | |

* cited by examiner

LIGHT FIXTURE WITH CENTRAL LIGHTING HOUSING AND PERIPHERAL COOLING HOUSING

CROSS-REFERENCE TO RELATED APPLICATIONS

This application is a nonprovisional of U.S. Provisional Patent Application No. 61/654,761, filed Jun. 1, 2012, and titled Light Fixture with Central Lighting Housing and Peripheral Cooling Housing, which is herein entirely incorporated by reference.

BACKGROUND

The present invention relates to light fixture cooling features, and particularly, to providing a light fixture with internal and external surfaces and cooling paths to facilitate cooling.

Managing the temperature of light sources in a light fixture is generally important to performance and longevity. This is particularly true with newer highly efficient lighting technology, for example, light sources such as LEDs or laser diodes. LEDs are generally selected to maximize the light output for a given power consumption at a reasonable cost. Because LED light sources operate at a much lower temperature than typical incandescent light sources, less energy is wasted in the form of heat production. However, LEDs tend to be more sensitive to operating temperature and lower operating temperatures also provide a much smaller temperature difference between the LED and the ambient environment, thus requiring greater attention to thermal management to transfer and dissipate any excess heat generated by the LED driver and emitter so that the design operating temperature for the components are not exceeded.

As temperatures rise, the efficacy of the LED is reduced, reducing the light output, and reducing the lifespan of the LED. LED lighting fixtures generally include both LED drivers and LED emitters. To facilitate dissipation of heat, convection, conduction, and radiation are available modes of heat transfer. For LED light fixtures, dissipation of heat by conduction is often provided by one or more LED packages being mounted on a heat sink The heatsink is generally integral with or thermally coupled with the light housing, which often includes external cooling fins to further facilitate the dissipation of heat from the light fixture by convection and radiation.

For example, one prior art design seeking to address these concerns provides fins between a central light housing and an outer rim that are thin in width and height, and thus provide vary little surface area to transfer heat from the light to the channel of air passing through the light fixture. Additionally, no structure limits visibility vertically through the cooling channels or redirects airflow horizontally across further surfaces of such a light fixture mounted to a ceiling or similar overhanging structure.

Another prior art design seeking to address these concerns provides a very narrow set of vertical airflow channels around the periphery of the central light housing, the channels formed by an outer ring and vertical cooling fins, and the vertical cooling fins extend radially inwardly above and toward the center of the central light housing. Thus, in the case of mounting the light fixture against a ceiling, any airflow extending upwardly through the very narrow airflow channels flows outwardly between the ceiling and top of the light fixture, and thus will not benefit provide from further heat exchange if the air flow had included flow across the radially inwardly extending fins on the top side of the central light housing.

Therefore, it is desirable to provide a lighting fixture design that maximizes cooling by thermal convection for the light emitter and driver in a central light package housing, shields the cooling features and through the fixture view from as many viewing angles as practical, and redirects vertical airflow to a radially outwardly direction and across further cooling structure when mounted against a ceiling.

SUMMARY

The present invention may comprise one or more of the features recited in the attached claims, and/or one or more of the following features and combinations thereof. An illustrative light fixture includes a cylindrical lighting package housing surrounded peripherally by a cooling housing providing airflow cooling channels. The airflow cooling channels are defined in the space between the circumference of the cylindrical lighting package housing and a rim around the periphery of the light fixture. The cooling housing provides wide and long openings for cool air to rise vertically from below the light fixture into the airflow channels defined in part by cooling fins and a horizontally arranged radial ring supporting the cooling fins. The airflow continues through radial exit channels, providing radially outward flow below a ceiling the fixture is mounted on. The arrangement of the radial ring fin support between the vertical cooling fins also eliminates or minimizes the view through the airflow channels and to the ceiling.

An illustrative embodiment of the light fixture includes a light package housing including emitters; an illumination side of the light package housing, the emitters projecting light from the illumination side; a top side of the light package housing, located opposite the illumination side; and a cooling housing extending peripherally around an outer circumference of the light package housing, the cooling housing including a plurality of cooling fins, a rim, and a radial ring fin support. The rim can couple the cooling fins around an outer circumference of the cooling housing, the plurality of cooling fins can span radially between the outer circumference of the light package housing, and the radial ring fin support can radially spans a portion of adjacent vertical fins between the rim and the outer circumference of the light package.

The radial ring fin support can form an annulus extending from the rim and inwardly toward the outer circumference of the light package housing such that a vertical cooling channel remains between the radial ring fin support, the outer circumference of the light package housing, and adjacent ones of the plurality of cooling fins. The radial ring fin support can span a substantial portion of the vertical openings between the rim, the outer circumference of the light package housing, and adjacent ones of the plurality of cooling fins. The bottom side of the radial ring fin support can redirect radially inwardly at least a substantial portion of the vertical cooling channel path extending upwardly from a bottom side of the support and between adjacent ones of the plurality of cooling fins.

The top side of the light package housing can include a flat portion for mounting the light fixture to a ceiling. The top side of the radial ring fin support, ceiling, and adjacent ones of the plurality of cooling fins can form cooling paths extending radially outward from an upper portion of the outer circumference of the light package housing. The light package housing can be about cylindrical.

The light package housing can further include at least one emitter driver and the cooling housing surrounds the outer circumference of the portion of the light package housing containing the at least one emitter driver. The cooling housing can surround the outer circumference of the portion of the light package housing containing the emitters.

The rim can spans vertically from the illumination side to the top side. The plurality of cooling fins can each include a top edge adjacent the outer circumference of the lighting package housing that is about coplanar with the top surface of the lighting package housing.

Another illustrative embodiment of a light fixture, includes a light package housing including emitters; an illumination side of the light package housing, the emitters projecting light from the illumination side; a top side of the light package housing, located opposite the illumination side; a cooling housing extending peripherally around an outer circumference of the light package housing, the cooling housing including a plurality of cooling fins, a rim, and a radial ring fin support; and a plurality of vertical cooling channels defined between the rim, outer circumference of the light package housing, and adjacent ones of the plurality of cooling fins. The rim can couple the cooling fins around an outer circumference of the cooling housing; the plurality of cooling fins can span radially between the outer circumference of the light package housing; and the radial ring fin support can radially span a portion of adjacent vertical fins between the rim and the outer circumference of the light package, a bottom side of the radial ring fin support redirects radially inwardly, toward the light package housing, each of the plurality of vertical cooling channels.

Yet another illustrative light fixture, includes a light package housing including emitters; an illumination side of the light package housing, the emitters projecting light from the illumination side; a top side of the light package housing, located opposite the illumination side; a cooling housing extending peripherally around an outer circumference of the light package housing, the cooling housing including a plurality of cooling fins, a rim, and a radial ring fin support; and a plurality of vertical cooling channels defined between the rim, outer circumference of the light package housing, and adjacent ones of the plurality of cooling fins. The rim can couple the cooling fins around an outer circumference of the cooling housing; the plurality of cooling fins can span radially between the outer circumference of the light package housing; and the radial ring fin support can forms an annulus extending from the rim and inwardly toward, but not touching, the outer circumference of the light package housing, and a bottom side of the radial ring fin support redirects radially inwardly, toward the light package housing, each of the plurality of vertical cooling channels.

Additional features of the disclosure will become apparent to those skilled in the art upon consideration of the following detailed description of the illustrative embodiment.

BRIEF DESCRIPTION OF THE DRAWINGS

The detailed description particularly refers to the accompanying figures in which.

DESCRIPTION OF THE ILLUSTRATIVE EMBODIMENTS

Figure 1:
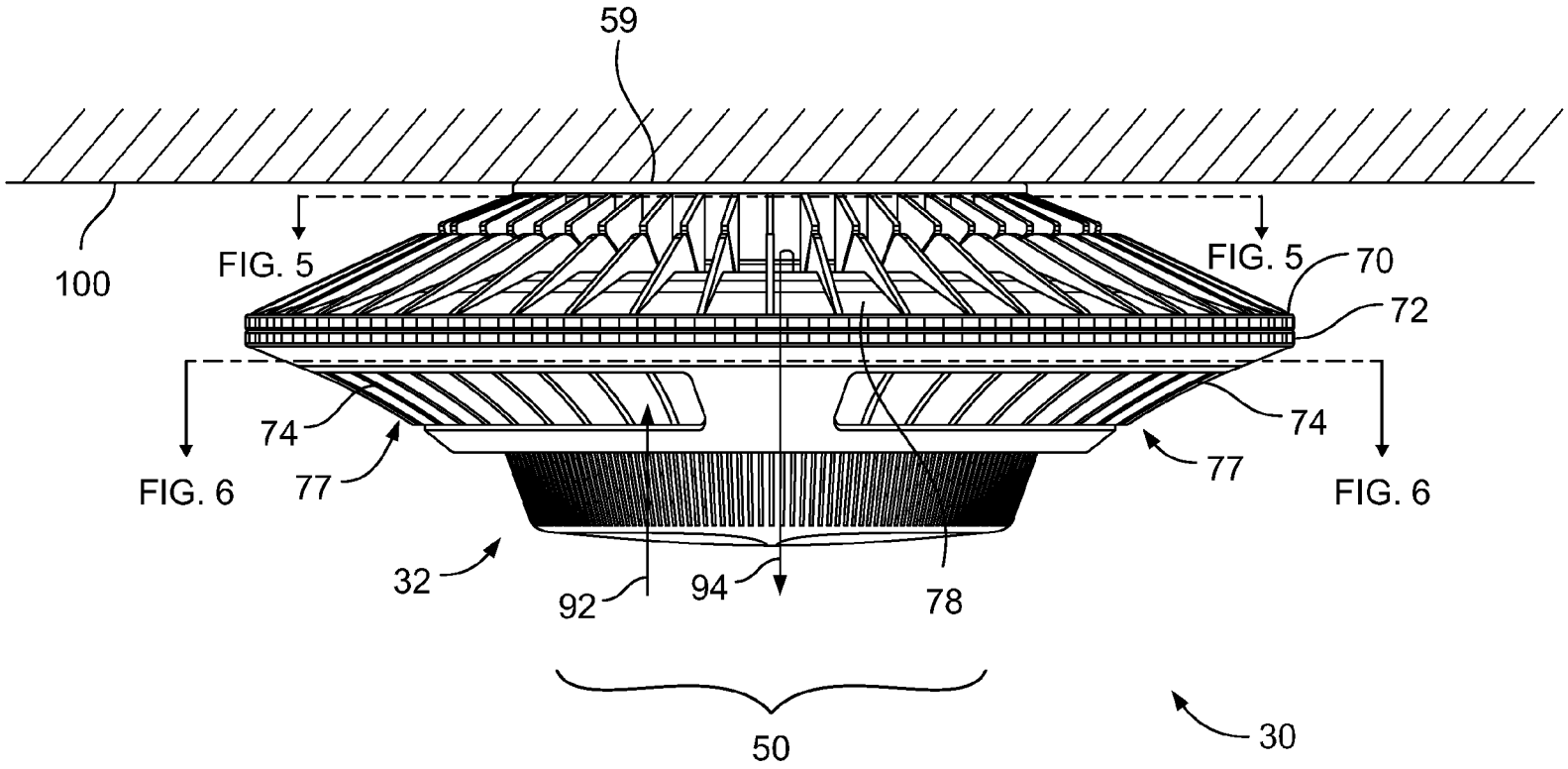
FIG. 1 is a side view of an illustrative lighting fixture according to the present invention mounted on a ceiling.

For the purposes of promoting and understanding the principals of the invention, reference will now be made to one or more illustrative embodiments illustrated in the drawings and specific language will be used to describe the same.

Referring to FIGS. 1-4, a first illustrative embodiment of a light fixture 30 according to the present invention is illustrated. The light fixture 30 includes a light source 32, including an emitter 34 (FIG. 2; as used herein, "emitter" refers to a single emitter or an array of emitters) and a driver 36 (FIGS. 4-5; as used herein, "driver" refers to a single driver or an array of drivers), contained within a central, cylindrical light package housing 50. The light fixture 30 also includes a cooling housing 60 encircling an outer circumference 52 of the light package housing 50.

The light source 32 may be, but is not limited to, an LED emitter 34 and associated driver 36, as are typically used in the commercial lighting industry. For example, the associated driver 36 converts AC power to appropriate DC power and may also include additional LED power and control features.

Figure 7:
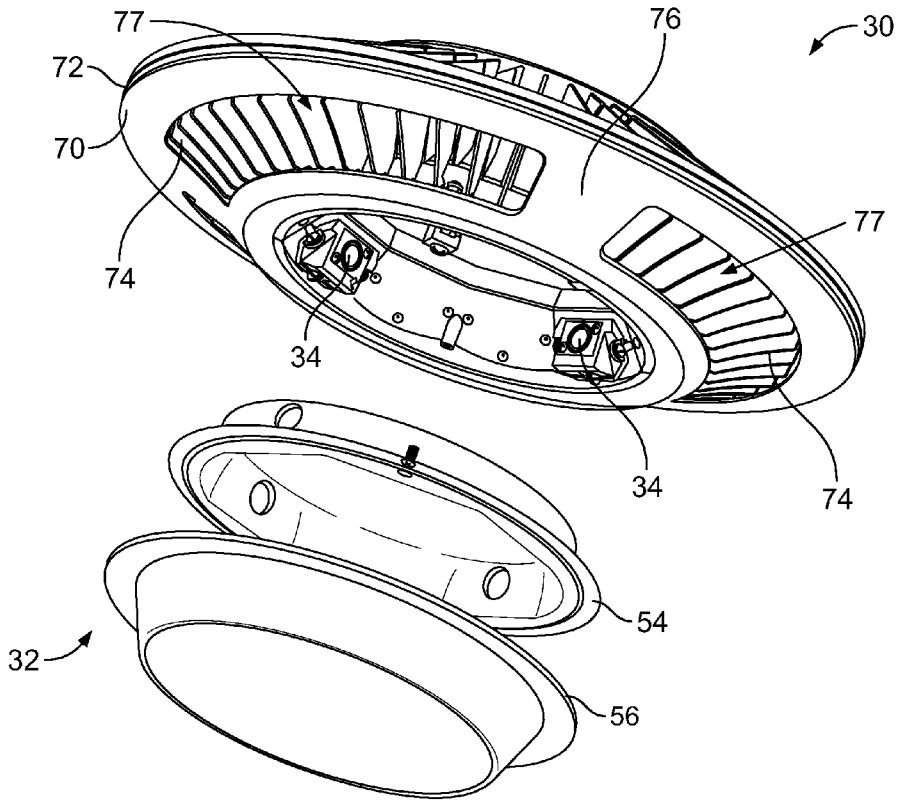
FIG. 7 is a bottom side perspective exploded view of the lighting fixture of FIG. 1.

The light package housing 50 and cooling housing 60 can be formed from, for example, die cast aluminum or an aluminum alloy. The housings 50 and 60 may be separately formed, integrally formed, or a portion of housing 50 may be integrally formed with housing 60, or vice-versa. The emitter 34 can be thermally coupled and mounted to the light package housing 50, which is thermally coupled to the cooling housing 60. For example, as shown in FIG. 7, the emitters 34 can be coupled with annular heat transfer surface 53, which are thermally coupled and/or integrally formed with vertical cooling fins 74 (discussed below).

As it typical of commercial lighting fixtures, the light package housing 50 may also include components that enclose the emitter 34 within light package housing 50, for example, including a light reflector 54 and lens or other cover 56 adjacent a bottom, illumination side 58. The light package housing 50 further houses and may enclose the driver 36, for example, adjacent a top side 59, opposite the illumination side 58. The top side 59 can be coupled to a ceiling 100 or other mounting, structural, or non-structural member.

Figure 2:
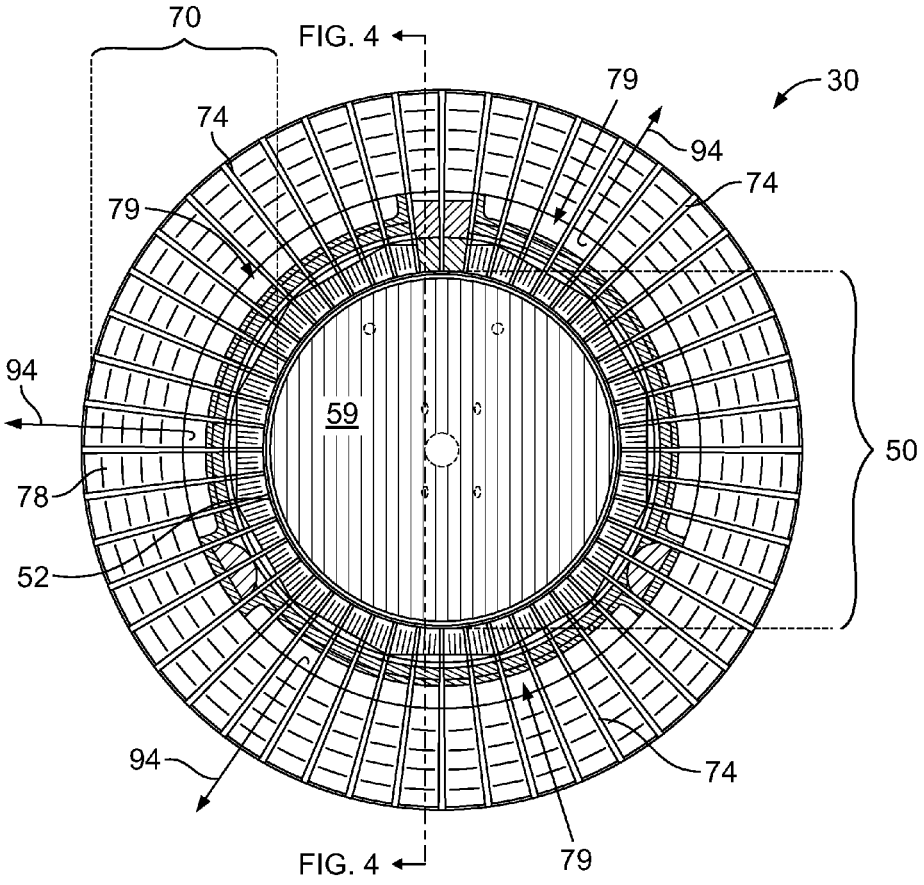
FIG. 2 is a top view of the lighting fixture of FIG. 1.
Figure 3:
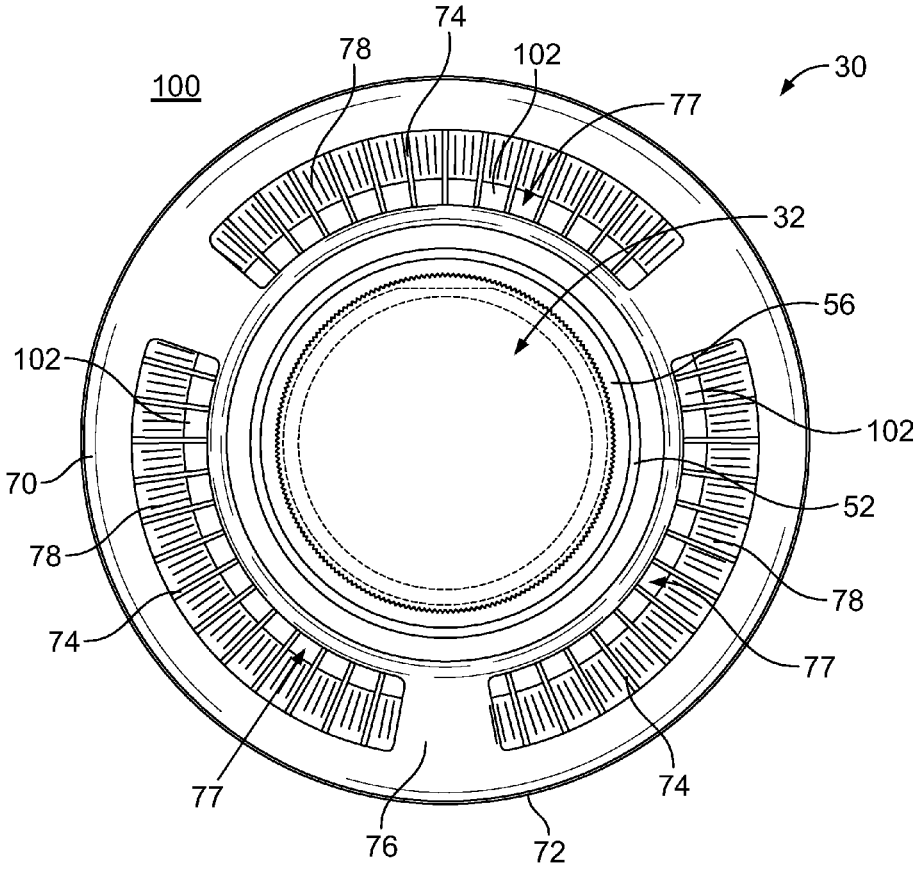
FIG. 3 is a bottom view of the lighting fixture of FIG. 1.
Figure 4:
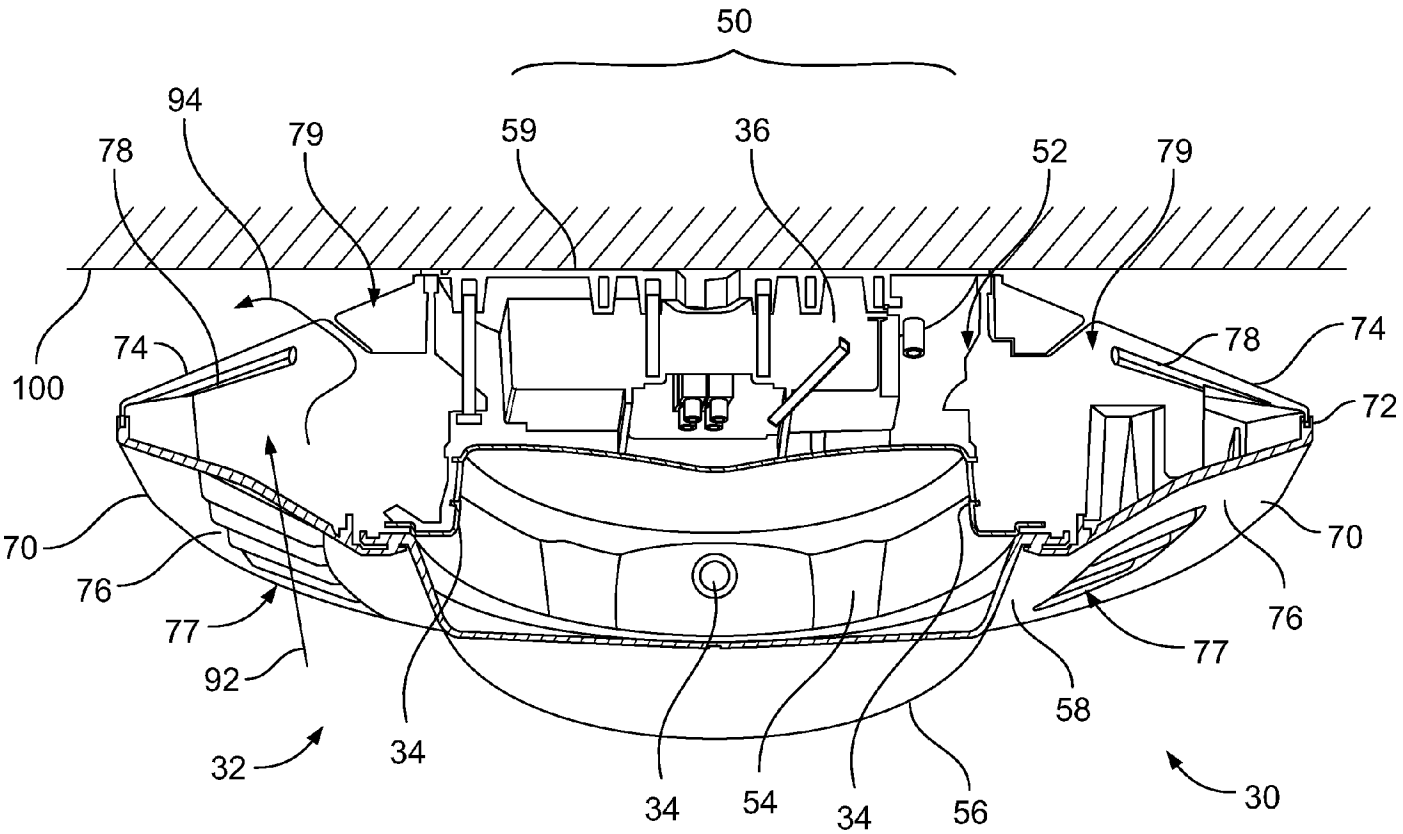
FIG. 4 is a bottom side perspective section view of the lighting fixture of FIG. 1, taken along sections line 4-4 shown in FIG. 2.
Figure 5:
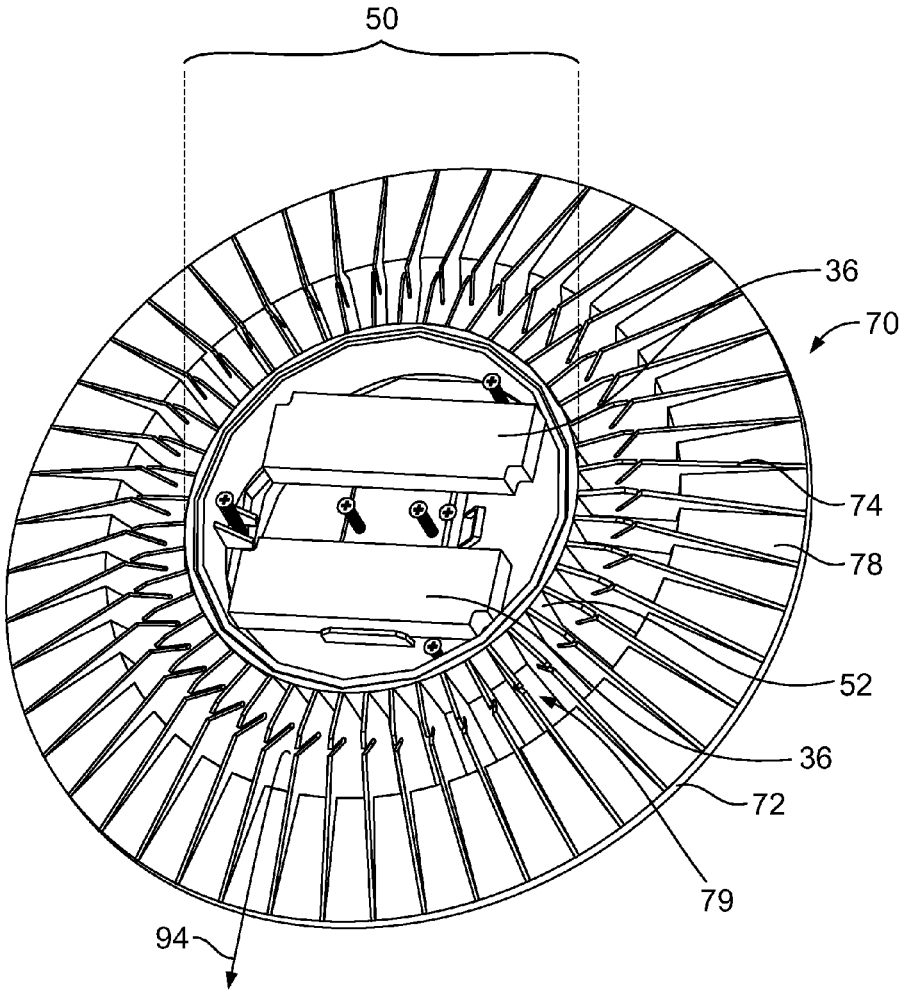
FIG. 5 is a top perspective section view of the lighting fixture of FIG. 1, taken along section line 5-5 shown in FIG. 1.
Figure 6:
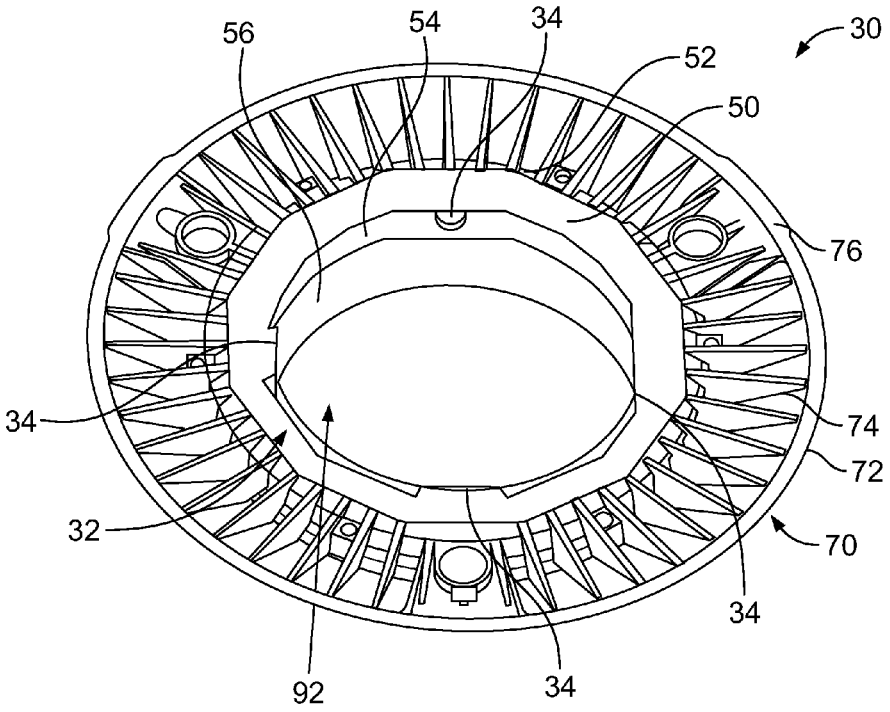
FIG. 6 is a top perspective section view of the lighting fixture of FIG. 1, taken along section line 6-6 shown in FIG. 1.

Referring to FIGS. 1-4, the cooling housing 70 defines a rim 72 around on outer circumference and a plurality of cooling fins 74 coupled between the outer circumference 52 of the light package housing 50 and the rim 72. The cooling housing 70 also defines a shroud 76 on the illumination side 58, and a radial ring fin support 78 nearer the top side 59. From the illumination side 58, the shroud 76 defines windows exposing openings 77 between adjacent cooling fins 74 and extending radially between the rim 72 and the outer circumference 52 of the light package housing 50 (FIGS. 3 and 4). From the top side 59, openings 79 are defined between adjacent cooling fins 74 and extend radially between the radial ring fin support 78 and the outer circumference 52 of the light package housing 50 (FIGS. 2 and 4).

The plurality of fins 74 are in thermal conductivity with the emitters 34 and dissipate heat from the emitters to the surrounding environment. More specifically, referring to FIG. 4, the first airflow cooling channels 92 are defined through openings 77 by the space between the rim 72, the outer circumference 52 of the light package housing 50, and each adjacent fin 74. The cooling channels 92 extend vertically from the bottom side 58 at openings 77, upwardly toward and along the bottom side of radial ring fin support 78, through openings 79 on the top side 79, and radially outward toward rim 72 and between fins 74 and along a top side of the radial ring fin support 78, as indicated by second airflow cooling channels 94 in FIGS. 2 and 4.

Advantageously, the above described and illustrated structure provides a path for cool air to flow upwardly into through openings 77, for heat from the light fixture 30 to be transferred into the airflow from the fins 74, radial ring fin support 74, and outer circumference 52 of the light package housing, and for the heated air to exit through openings 79 and flow away from the light fixture 30. Optionally, the cooling fins 74 can be parallel, and/or evenly spaced, as shown in FIGS. 1-3. The first and second airflow cooling channels 92 and 94 span around the circumference of the light fixture 30 between the rim 72 and outer circumference 52 of the light package housing 50, except where interrupted by shroud 76 between adjacent openings 77 (FIG. 3).

Advantageously, radial ring fin support 78 provides support to the fins 74 and more surface area for convective and radiant heat transfer to the surrounding air than the fins 74 and outer circumference 52 of the light package housing 50 alone provide. Also advantageously, stylistic aspects of the rim 72, shroud 76, and the radial ring fin support 78 and their relative arrangement provide a more aesthetically appealing appearance of the light fixture 30, limiting the spiny look typical of LED lighting fixtures covered with cooling fins, while also retaining the needed cooling surface area, cooling air paths, and arrangement of the cooling fins 74 projecting beyond the outer circumference of the light package housing 50. For example, in addition to any functionality provided, the rims 72, shroud 76, and radial ring fin support 78 also aesthetically conceal portions of the light fixture 30, and eliminate or substantially limit the vertical see through of the ceiling 100 from the illumination side 58. As shown in FIG. 3, only a narrow band 102 of the ceiling 100 is visible through the windows 77 and radially inside of the radial ring fin support 78. Adding further aesthetic appeal, the illumination side of the cooling housing 60 can slope upwardly between the outer circumference 52 of the light package housing 50 and rim 72, and the top side of the cooling housing 60 can slope downwardly between the outer circumference of the light package housing and rim.

While the invention has been illustrated and described in detail in the foregoing drawings and description, the same is to be considered as illustrative and not restrictive in character, it being understood that only illustrative embodiments thereof have been shown and described and that all changes and modifications that come within the spirit and scope of the invention as defined in the claims and summary are desired to be protected.

The invention claimed is:

1. A light fixture, comprising:

an light package housing including emitters;

an illumination side of the light package housing, the emitters projecting light from the illumination side;

a top side of the light package housing, located opposite the illumination side; and a cooling housing extending peripherally around an outer circumference of the light package housing, the cooling housing including a plurality of cooling fins, a rim, and a radial ring fin support; and wherein:

the rim couples the cooling fins around an outer circumference of the cooling housing;

the plurality of cooling fins span radially between the outer circumference of the light package housing and the rim; and the radial ring fin support radially spans a portion of adjacent vertical fins between the rim and the outer circumference of the light package.

2. The light fixture of claim 1, wherein the radial ring fin support forms an annulus extending from the rim and inwardly toward the outer circumference of the light package housing such that a vertical cooling channel remains between the radial ring fin support, the outer circumference of the light package housing, and adjacent ones of the plurality of cooling fins.

3. The light fixture of claim 1, wherein the radial ring fin support spans a substantial portion of the vertical openings between the rim, the outer circumference of the light package housing, and adjacent ones of the plurality of cooling fins.

4. The light fixture of claim 1, wherein the bottom side of the radial ring fin support redirects radially inwardly at least a substantial portion of the vertical cooling channel path extending upwardly from a bottom side of the support and between adjacent ones of the plurality of cooling fins.

5. The light fixture of claim 1, wherein the top side of the light package housing includes a flat portion for mounting the light fixture to a ceiling.

6. The light fixture of claim 5, wherein the top side of the radial ring fin support, ceiling, and adjacent ones of the plurality of cooling fins form cooling paths extending radially outward from an upper portion of the outer circumference of the light package housing.

7. The light fixture of claim 1, wherein the light package housing is about cylindrical.

8. The light fixture of claim 1, wherein the light package housing further includes at least one emitter driver and the cooling housing surrounds the outer circumference of the portion of the light package housing containing the at least one emitter driver.

9. The light fixture of claim 1, wherein the cooling housing surrounds the outer circumference of the portion of the light package housing containing the emitters.

10. The light fixture of claim 1, wherein the rim spans vertically from the illumination side to the top side.

11. The light fixture of claim 1, wherein the plurality of cooling fins each include top edge adjacent the outer circumference of the lighting package housing that is about coplanar with the top surface of the lighting package housing.

12. A light fixture, comprising:

an light package housing including emitters;

an illumination side of the light package housing, the emitters projecting light from the illumination side;

a top side of the light package housing, located opposite the illumination side;

a cooling housing extending peripherally around an outer circumference of the light package housing, the cooling housing including a plurality of cooling fins, a rim, and a radial ring fin support; and, a plurality of vertical cooling channels defined between the rim, outer circumference of the light package housing, and adjacent ones of the plurality of cooling fins; and wherein:

the rim couples the cooling fins around an outer circumference of the cooling housing;

the plurality of cooling fins span radially between the outer circumference of the light package housing; and the radial ring fin support radially spans a portion of adjacent vertical fins between the rim and the outer circumference of the light package, a bottom side of the radial ring fin support redirects radially inwardly, toward the light package housing, each of the plurality of vertical cooling channels.

13. The light fixture of claim 12, wherein the radial ring fin support forms an annulus extending from the rim and inwardly toward the outer circumference of the light package housing.

14. The light fixture of claim 12, wherein the radial ring fin support spans a substantial portion of the vertical openings between the rim, the outer circumference of the light package housing, and adjacent ones of the plurality of cooling fins.

15. The light fixture of claim 12, wherein the top side of the light package housing includes a flat portion for mounting the light fixture to a ceiling.

16. The light fixture of claim 15, wherein the top side of the radial ring fin support, ceiling, and adjacent ones of the plurality of cooling fins form cooling paths extending radially outward from an upper portion of the outer circumference of the light package housing.

17. The light fixture of claim 12, wherein the light package housing is about cylindrical.

18. The light fixture of claim 12, wherein the light package housing further includes at least one emitter driver and the cooling housing surrounds the outer circumference of the portion of the light package housing containing the at least one emitter driver.

19. The light fixture of claim 12, wherein the cooling housing surrounds the outer circumference of the portion of the light package housing containing the emitters.

20. A light fixture, comprising:

an light package housing including emitters;

an illumination side of the light package housing, the emitters projecting light from the illumination side;

a top side of the light package housing, located opposite the illumination side;

a cooling housing extending peripherally around an outer circumference of the light package housing, the cooling housing including a plurality of cooling fins, a rim, and a radial ring fin support; and, a plurality of vertical cooling channels defined between the rim, outer circumference of the light package housing, and adjacent ones of the plurality of cooling fins; and wherein:

the rim couples the cooling fins around an outer circumference of the cooling housing;

the plurality of cooling fins span radially between the outer circumference of the light package housing; and the radial ring fin support forms an annulus extending from the rim and inwardly toward, but not touching, the outer circumference of the light package housing, and a bottom side of the radial ring fin support redirects radially inwardly, toward the light package housing, each of the plurality of vertical cooling channels.

* * * * *